US009437049B2

(12) United States Patent
Barrett et al.

(10) Patent No.: US 9,437,049 B2
(45) Date of Patent: Sep. 6, 2016

(54) TICKET DISPENSER

(71) Applicants: John Barrett, Cheshire (GB); Stephen Matthews, Cheshire (GB)

(72) Inventors: John Barrett, Cheshire (GB); Stephen Matthews, Cheshire (GB)

(73) Assignee: FASTRAK RETAIL (UK) LIMITED, Macclesfield, Cheshire (GB)

( * ) Notice: Subject to any disclaimer, the term of this patent is extended or adjusted under 35 U.S.C. 154(b) by 0 days.

(21) Appl. No.: 14/345,359

(22) PCT Filed: Sep. 19, 2012

(86) PCT No.: PCT/GB2012/052312

§ 371 (c)(1),
(2) Date: Mar. 17, 2014

(87) PCT Pub. No.: WO2013/041858

PCT Pub. Date: Mar. 28, 2013

(65) Prior Publication Data

US 2014/0346187 A1 Nov. 27, 2014

(30) Foreign Application Priority Data

Sep. 19, 2011 (GB) ..... 1116154.4

(51) Int. Cl.
*G07B 3/00* (2006.01)
*E05B 63/14* (2006.01)
(Continued)

(52) U.S. Cl.
CPC ..... *G07B 3/00* (2013.01); *E05B 63/14* (2013.01); *E05B 65/0003* (2013.01); *E05C 3/042* (2013.01); *G07B 5/00* (2013.01); *G07C 9/00944* (2013.01)

(58) Field of Classification Search
CPC ..... G07B 3/00; G07B 3/02; G07B 3/04; G07B 5/00; G07B 5/06; G07C 9/00944; E05C 7/00; E05C 9/00; E05C 3/042; E05B 63/14; E05B 65/0003
USPC ..... 221/154
See application file for complete search history.

(56) References Cited

U.S. PATENT DOCUMENTS 4,544,081 A 10/1985 Voegeli
4,738,384 A * 4/1988 Tigner ..... B65H 35/002 225/16

(Continued)

FOREIGN PATENT DOCUMENTS

CN 201546498 8/2010
DE 10322676 A1 12/2004

(Continued)

OTHER PUBLICATIONS

Office Action from counterpart Chinese Application No. 201280045429.1, dated Jun. 2, 2015, 6 pp.

(Continued)

*Primary Examiner* — Patrick Mackey
(74) *Attorney, Agent, or Firm* — Shumaker & Sieffert, P.A.

(57) ABSTRACT

A ticket dispenser comprising a housing body, a lockable housing door configured to close an opening in the housing body, a ticket dispensing aperture, a lockable security cover configured to prevent the removal of tickets through the aperture, and a lock assembly, wherein the lock assembly is configured to lock the housing door and security cover when in a first orientation, wherein the lock assembly is configured to lock the housing door and not to lock the security cover when in a second orientation, and wherein the lock assembly is configured not to lock the housing door or the security cover when in a third orientation.

20 Claims, 16 Drawing Sheets

(51) Int. Cl.

| | |
|---|---|
| ***E05B 65/00*** | (2006.01) |
| ***G07B 5/00*** | (2006.01) |
| ***G07C 9/00*** | (2006.01) |
| ***E05C 3/04*** | (2006.01) |

(56) References Cited

U.S. PATENT DOCUMENTS

| | | | | |
|---|---|---|---|---|
| 4,739,637 | A | 4/1988 | Finkel et al. | |
| 5,100,038 | A * | 3/1992 | Schafer | A47K 10/426 225/32 |
| 5,287,980 | A * | 2/1994 | Saltz | G07B 3/04 206/509 |
| 5,492,398 | A * | 2/1996 | Schafer | B65H 35/0006 206/394 |
| 5,606,883 | A * | 3/1997 | Svec | E05B 9/084 292/DIG. 38 |
| 5,697,233 | A | 12/1997 | Albert et al. | |
| 5,857,364 | A | 1/1999 | Hsu et al. | |
| 5,873,481 | A * | 2/1999 | Gruhn | E05C 7/02 206/390 |
| 5,992,665 | A | 11/1999 | Deeter | |
| 6,050,448 | A * | 4/2000 | Willis | G07F 11/22 221/154 |
| 6,095,624 | A * | 8/2000 | Wilbert | G07B 3/04 312/293.3 |
| 6,098,837 | A * | 8/2000 | Izawa | G07D 11/0012 221/154 |
| 7,413,212 | B2 | 8/2008 | Hsai | |
| 7,565,999 | B1 * | 7/2009 | Jensen | G07F 17/42 220/210 |
| 7,665,394 | B2 * | 2/2010 | Roberts | G07F 11/68 221/1 |
| 7,717,256 | B1 | 5/2010 | Jensen | |
| 2005/0173447 | A1 * | 8/2005 | Jensen | B65H 35/00 221/45 |
| 2006/0016826 | A1 | 1/2006 | Jensen | |

FOREIGN PATENT DOCUMENTS

| | | | |
|---|---|---|---|
| EP | 0416507 | A2 | 3/1991 |
| EP | 0930588 | A2 | 7/1999 |
| EP | 2026289 | A1 | 2/2009 |
| GB | 205164 | | 10/1926 |
| GB | 377699 | | 7/1932 |
| GB | 2325326 | A | 11/1998 |
| JP | 0916818 | A | 1/1997 |

OTHER PUBLICATIONS

Invitation to Pay Additional Fees for corresponding PCT Application No. PCT/GB2012/052312, dated Dec. 4, 2012 (5 pgs.).

Search Report for corresponding GB Application No. 1116154.4, dated Jan. 16, 2012 (4 pgs.).

Search Report for corresponding GB Application No. 1116154.4, dated May 24, 2012 (4 pgs.).

Response to the Communication with Amended claims for counterpart EP Application No. 1277191.0, dated Nov. 17, 2014, (9 pgs.).

* cited by examiner

TICKET DISPENSER

This application is a national stage entry under 35 U.S.C. §371 of PCT Application No. PCT/GB2012/052312, filed Sep. 19, 2012, which claims the benefit of Great Britain Application No. 1116154.4, filed Sep. 19, 2011. The entire contents of each of PCT Application No. PCT/GB2012/052312 and Great Britain Application No. 1116154.4 are incorporated herein by reference.

The present invention relates to a ticket dispenser for dispensing cards stored as a ribbon within the dispenser, and more particularly for dispensing lottery tickets.

BACKGROUND

Lottery tickets are commonly manufactured as a ribbon-like length of card, with individual tickets separated by a line of perforations, such that they may be torn off from an end of the ribbon.

An example of a known design of housing for the display and dispensing of lottery tickets from such a ribbon has a housing body with a pivotable, opening housing door. The housing door can be locked closed to the housing body. The housing door has an elongate dispensing aperture. When the end of the ribbon of tickets positioned to project through the aperture, from within the housing, tickets may be dispensed through the aperture. A pair of rollers is provided, over which tickets pass as they are withdrawn from within the housing. A pivotable security cover can be locked to cover the dispensing aperture and prevent unauthorised withdrawal of tickets from within the housing. The lock assembly is mounted in the main door and the security cover is locked by the engagement of a single, common locking arm through a locking slot in each of the security cover and the main housing body.

In such a device, the security cover is not separately lockable from the main door. Further, the free end of the ribbon of tickets can spring back into the housing, and withdraw from the dispensing aperture, requiring the main door of the housing to be unlocked, and the security of the whole ribbon to be compromised, so that the free end of the ribbon of tickets can be re-threaded into the dispensing aperture to enable further tickets to be dispensed. Yet further, such devices are difficult to detachably secure to the counter in a retail outlet. Also, each such device requires to be separately secured to the retail counter.

A further example of a known design of housing for the display and dispensing of lottery tickets from a ribbon of tickets has a housing having one or more divider portions that partially divide the interior of the housing, to facilitate the separate dispensing of tickets from two or more different ribbons of tickets that are stored side-by-side within the housing.

Such devices having housings configured for a plurality of ticket ribbons are larger than devices having housings configured for dispensing from only a single ribbon of tickets, and more cumbersome, increasing transport and storage expenses. Further, the provision of different sizes of device, to accommodate different numbers of ribbons of tickets increases manufacturing expenses. Yet further, such devices impose limitations upon the arrangement of the retail display of the ribbons of tickets.

Examples of known designs of housing for the display and dispensing of lottery tickets from such a ribbon are found in U.S. Pat. No. 5,873,481 and U.S. Pat. No. 5,492,398.

SUMMARY OF THE INVENTION

According to a first aspect, there is provided a ticket dispenser comprising a housing body, a lockable housing door configured to close an opening in the housing body, a ticket dispensing aperture, a lockable security cover configured to prevent the removal of tickets through the aperture, and a lock assembly, wherein the lock assembly is configured to lock the housing door and security cover when in a first orientation, wherein the lock assembly is configured to lock the housing door and not to lock the security cover when in a second orientation, and wherein the lock assembly is configured not to lock the housing door or the security cover when in a third orientation.

The lock assembly may comprise a rotatable central lock mechanism having an axis of rotation a multi-way locking arm transverse to the axis of rotation having a first locking portion with a radial extent of R1, a second locking portion having a radial extent of R2, wherein R2 is less than R1, and a further portion having a radial extent of less than R2.

The lock assembly may be configured such that a master key may change the lock assembly between the first, second and third orientations, but a servant key may only change the lock assembly between the first and second orientations.

According to a second aspect, there is provided a ticket dispenser comprising a housing, a ticket dispensing aperture in a wall of the housing, and a ledge projecting from the wall that is external to the housing and adjacent to the aperture, and a pivotable ticket control cam, wherein the housing is configured for the dispensing of tickets out through the aperture between the control cam and the ledge, the control cam is configured to urge tickets against the ledge to hinder the return of tickets into the ticket dispenser the pivotable ticket control cam comprises an indentation configured to receive a user's digit for manually jamming the control cam against the ledge.

Advantageously, the indentation facilitates a user in jamming a ribbon of tickets between the control cam and the ledge, to restrain movement of the ribbon, when tearing off a length of the ribbon.

The housing may be configured for tickets to be dispensed in a dispensing direction and the centre of mass of the pivotable ticket control cam may be further from the centre of the ticket dispenser than a pivot axis of the control cam, in the dispensing direction.

The pivotable ticket control cam may be biased towards the ledge.

The pivotable ticket control cam may have a recess to facilitate a user's access to a ticket located between the control cam and the ledge.

The ticket dispenser may comprise a slideable security cover configured to slide between an open position in which a ribbon of tickets may be withdrawn from within the dispenser, and a closed position in which the security cover prevents withdrawal of tickets through the ticket dispensing aperture from within the dispenser.

According to a third aspect, there is provided a ticket dispensing module having a housing body with opposed first and second faces provided with first and second complementary slideable engagement elements and latching elements, the first slideable engagement element of a first module being engageable with the second slideable engagement element of a corresponding, second module, by relative displacement of the modules, wherein the first and second slideable engagement elements of the modules are configured to prevent separation of the modules transverse to the direction of relative displacement when they are engaged, and wherein the latching elements are configured to become engaged when the first and second slideable engagement elements are engaged, and the latching elements are configured to prevent further relative displacement of the modules once the latching elements are engaged.

The housing body may have opposed third and fourth faces each connecting between the first and second face, and wherein the third and fourth face are provided with complementary slideable engagement elements and latching elements.

The module may have a base provided with a slideable engagement element and a latching element complementary to a face of the module.

Preferably, the first slideable engagement elements are elongate and bulbous in cross-section, and the second slideable engagement elements are complementarily shaped grooves configured to mate with first slideable engagement elements of corresponding modules.

The first and second slideable engagement elements may be elongate, and at least one of the slideable engagement elements may be tapered along the direction of elongation.

Preferably, the first and second slideable engagement elements are each configured to mate along less than half the length of the module, when mated with a corresponding engagement element.

Preferably, each of the opposed first and second faces are provided with at least two slideable engagement elements that are spaced apart.

Preferably, one of the opposed first and second faces is provided with a hook and the other of the opposed first and second faces is provided with a complementary hook engagement hole.

The latching elements may comprise a resiliently deflectable projection and a projection engagement hole.

The module may comprise a door and the door may inhibit deflection of the projection when the door is in the closed position.

BRIEF DESCRIPTION OF THE DRAWINGS

Embodiments of the present invention are further described hereinafter with reference to the accompanying drawings, in which.

DETAILED DESCRIPTION

Like numbers refer to like elements throughout.

Figure 1A:
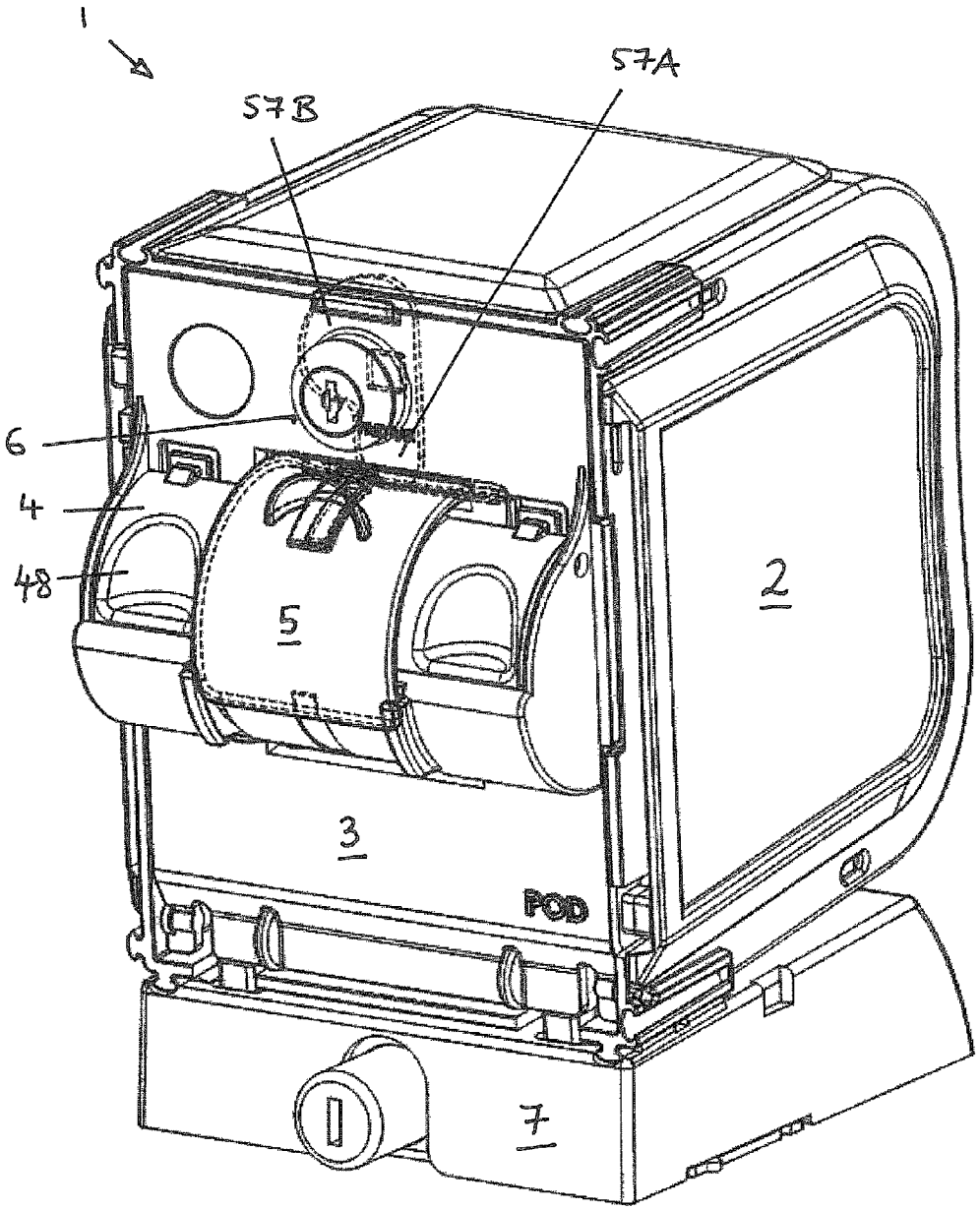
FIG. 1A shows a ticket dispenser comprising a ticket dispensing module and a base assembly, with the lock assembly in a first mode of operation.
Figure 1B:
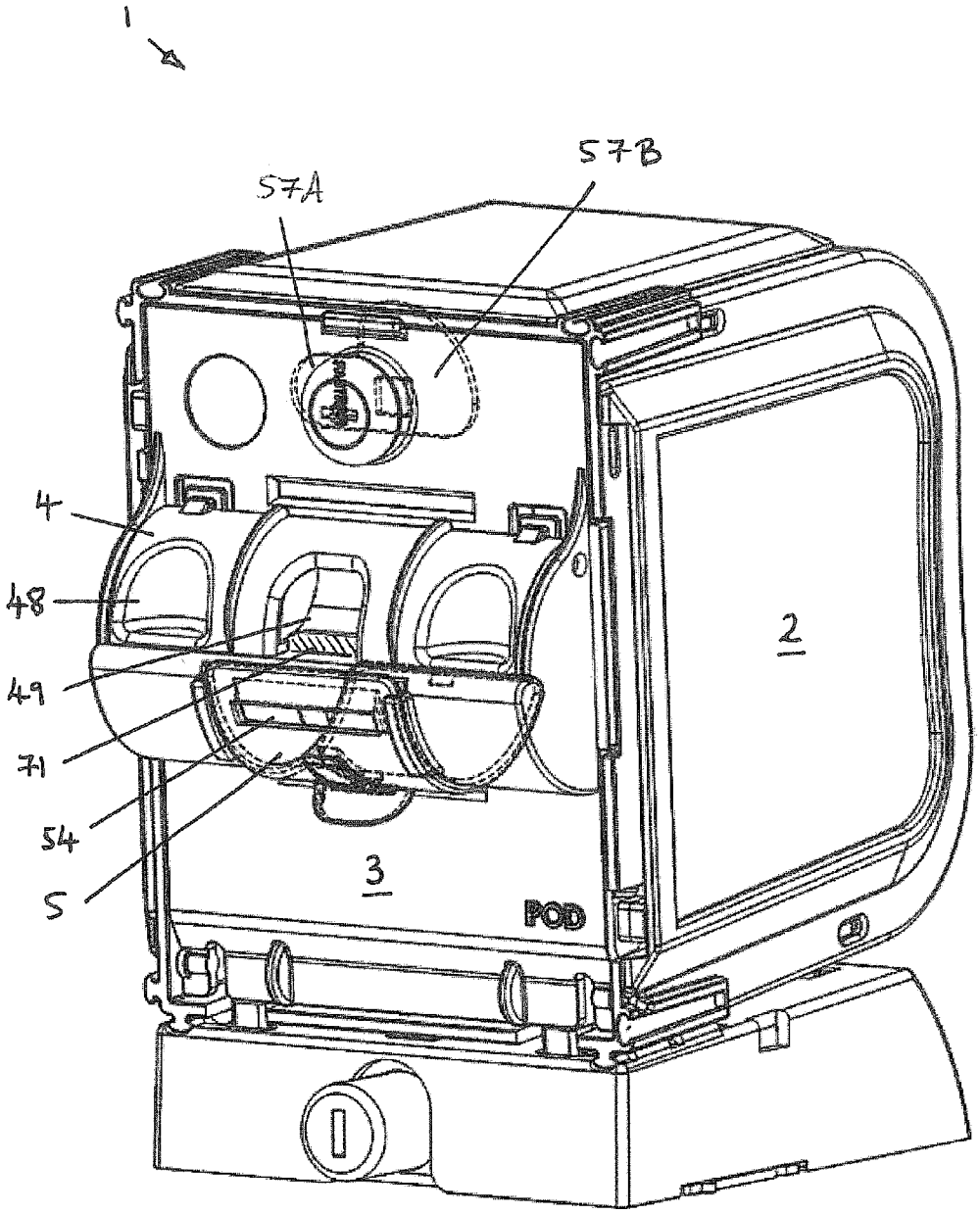
FIG. 1B shows a ticket dispenser comprising a ticket dispensing module and a base assembly, with the lock assembly in a second mode of operation.
Figure 1C:
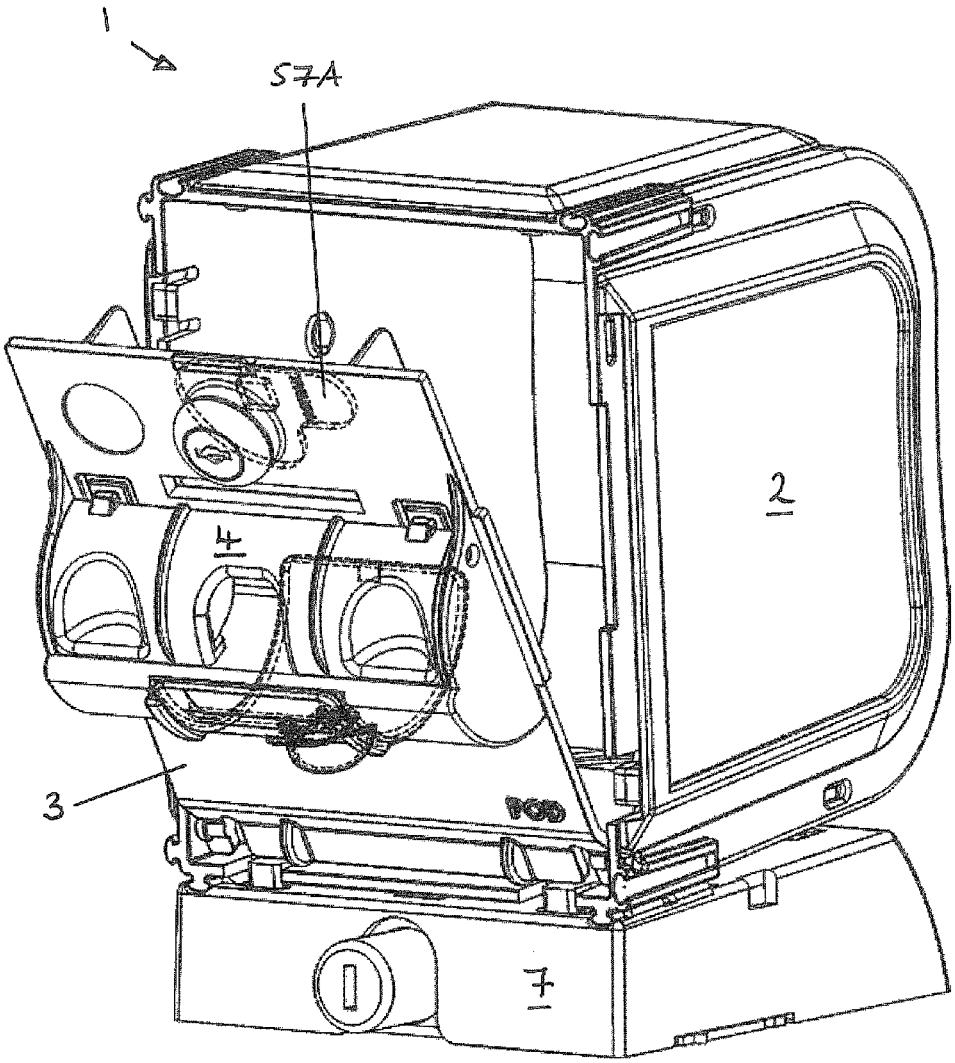
FIG. 1C shows a ticket dispenser comprising a ticket dispensing module and a base assembly, with the lock assembly in a third mode of operation.
Figure 2A:
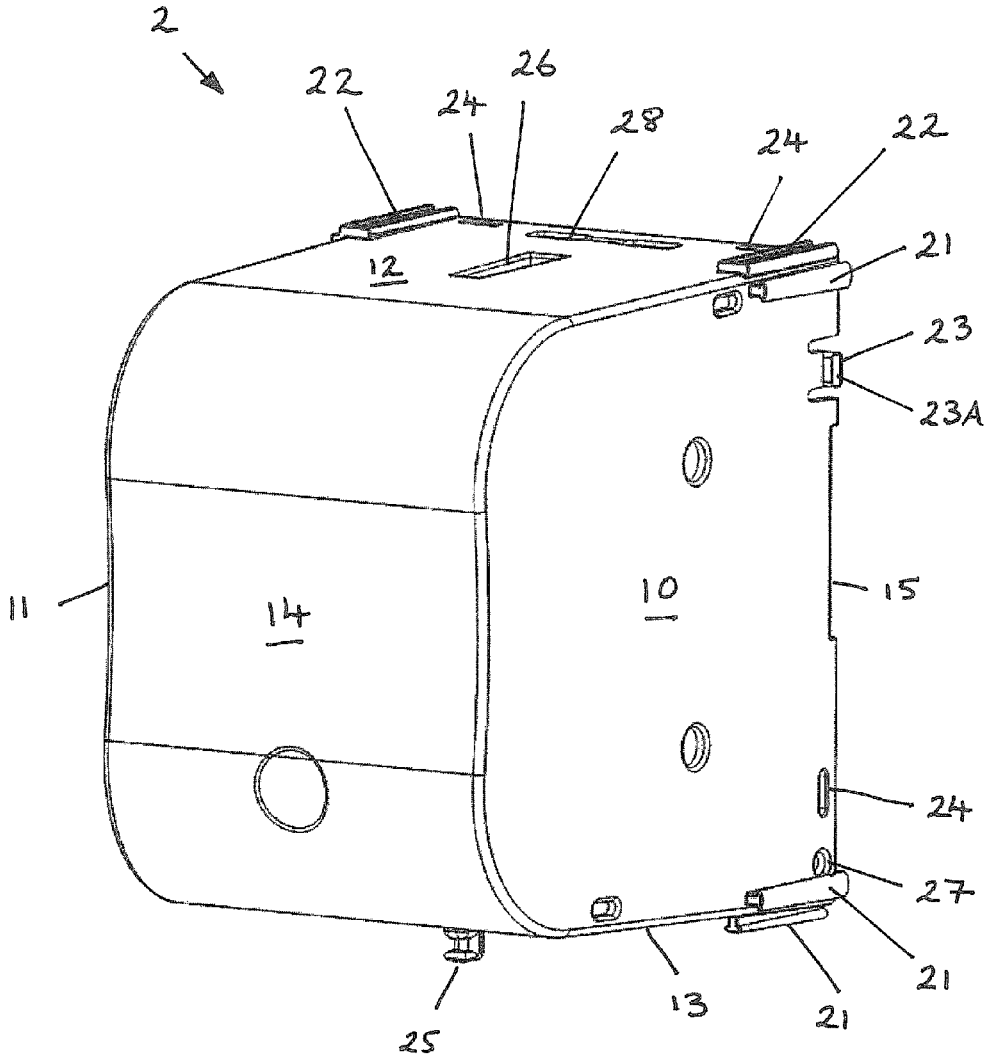
FIG. 2A shows a housing body.
Figure 2B:
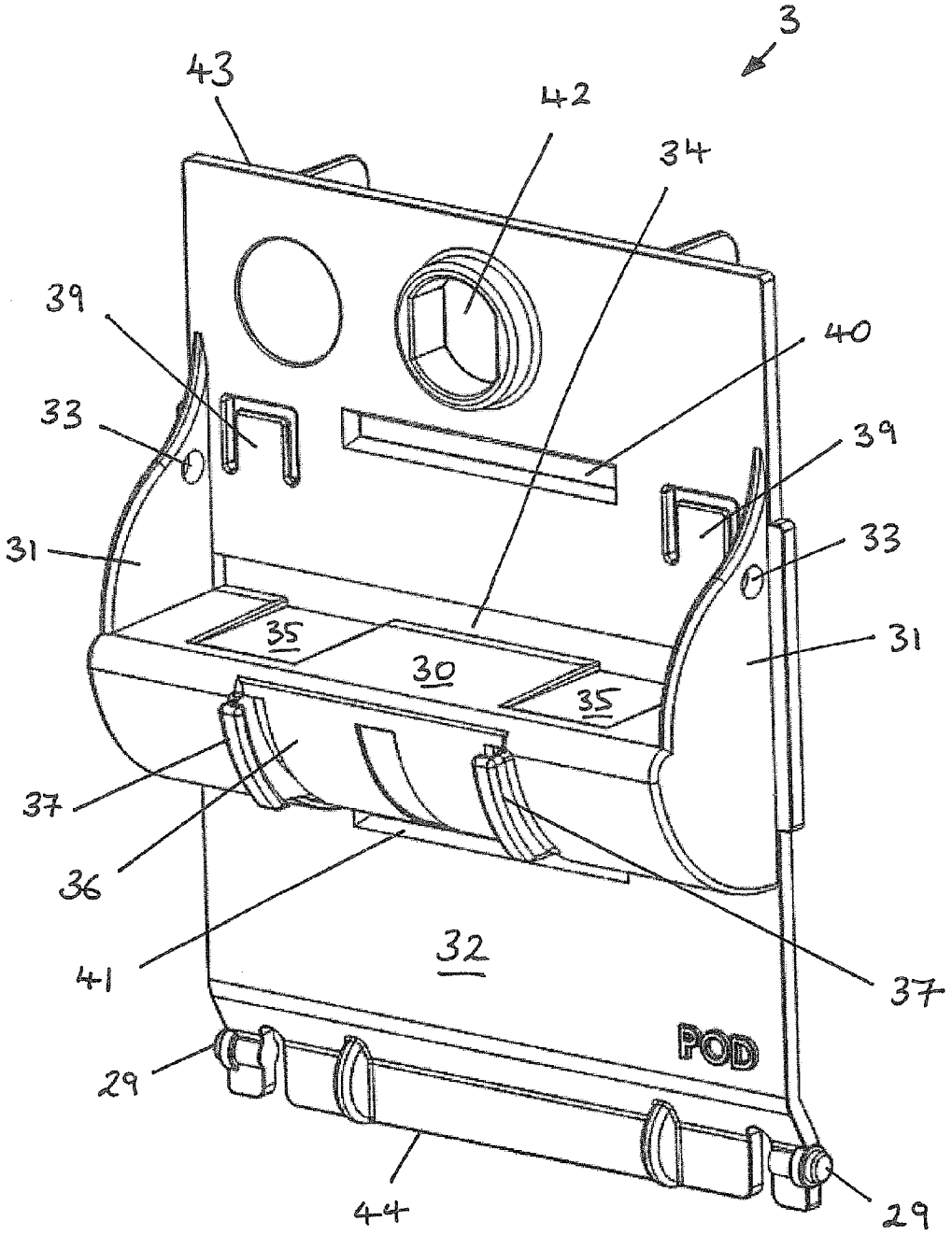
FIG. 2B shows a housing door.
Figure 2C:
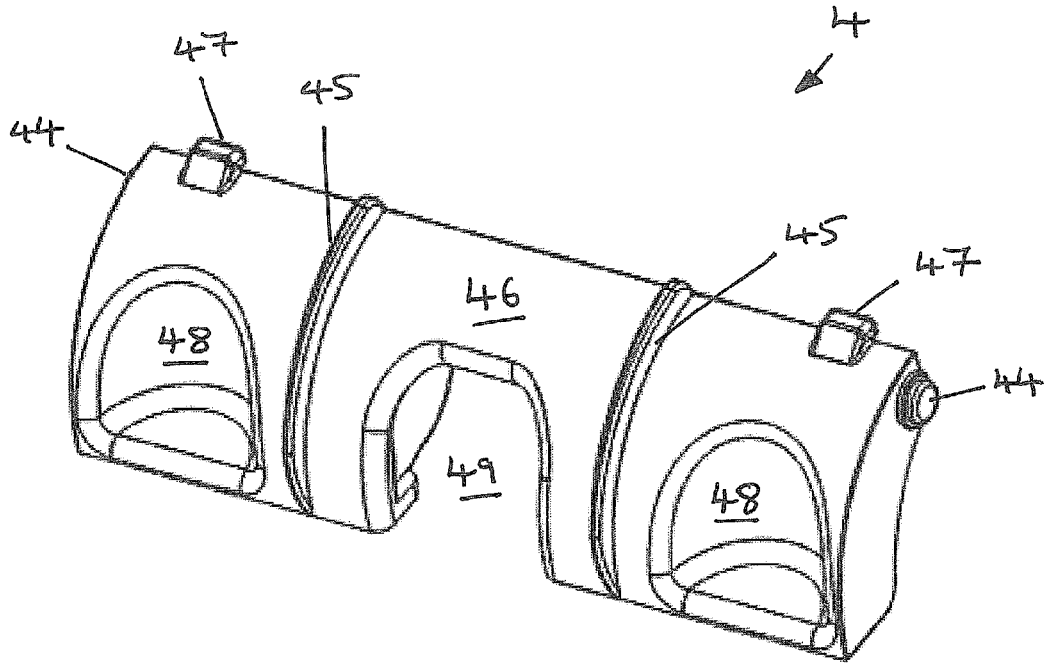
FIG. 2C shows a ticket control cam.
Figure 2D:
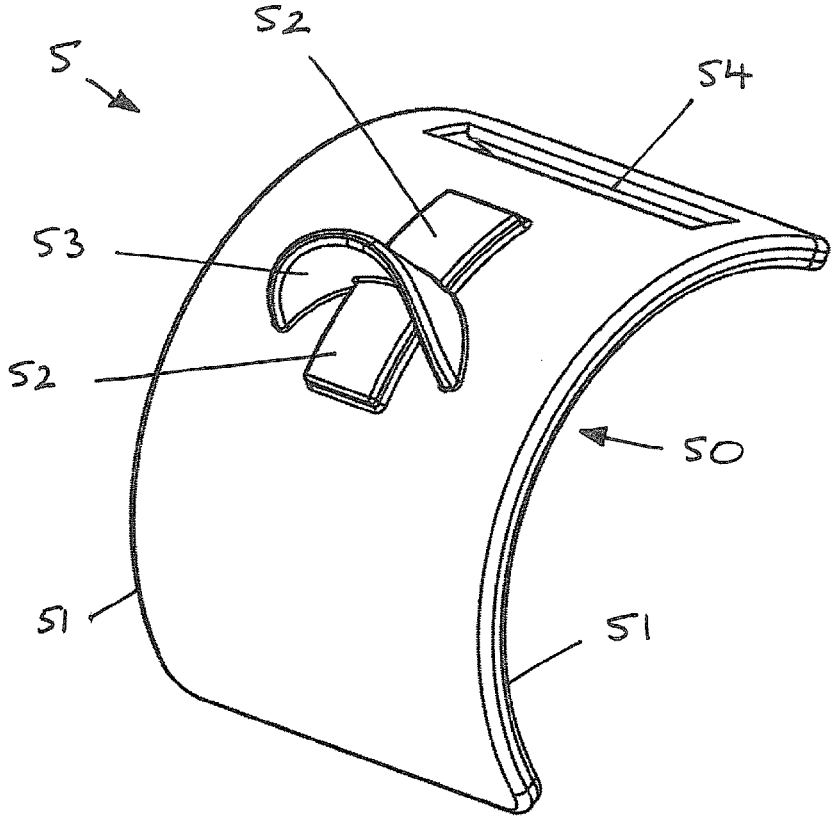
FIG. 2D shows a security cover.
Figure 2E:
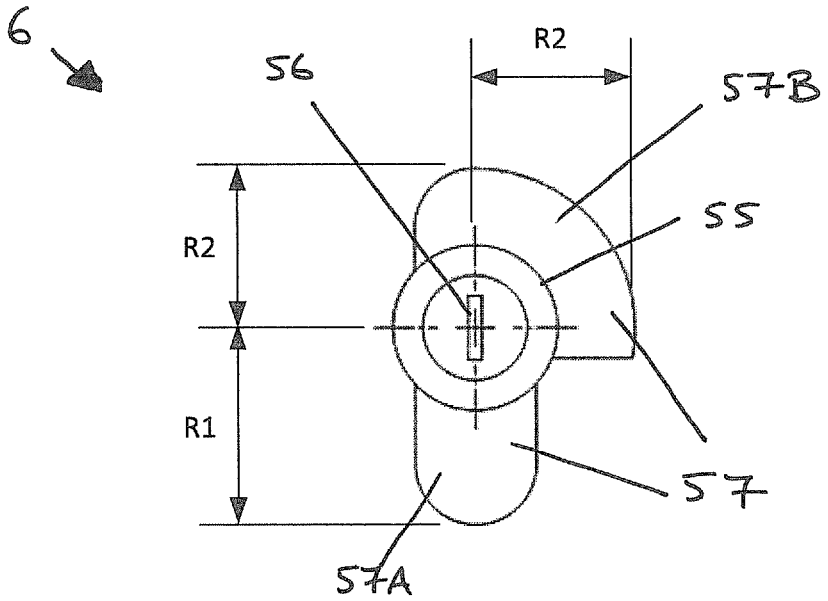
FIG. 2E shows a lock assembly.
Figure 2F:
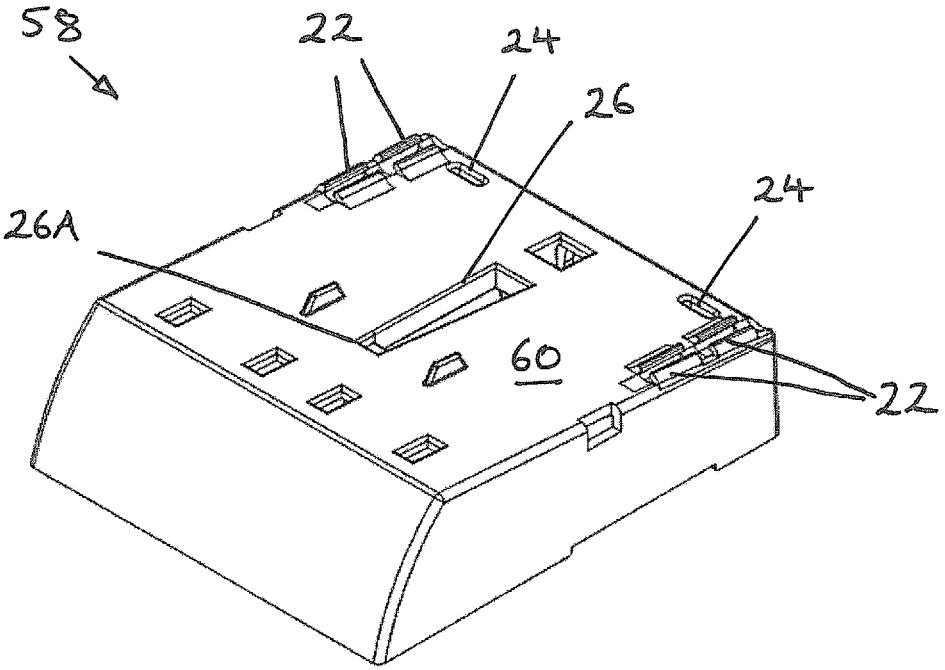
FIGS. 2F and 2G show a ticket dispenser base unit.
Figure 2G:
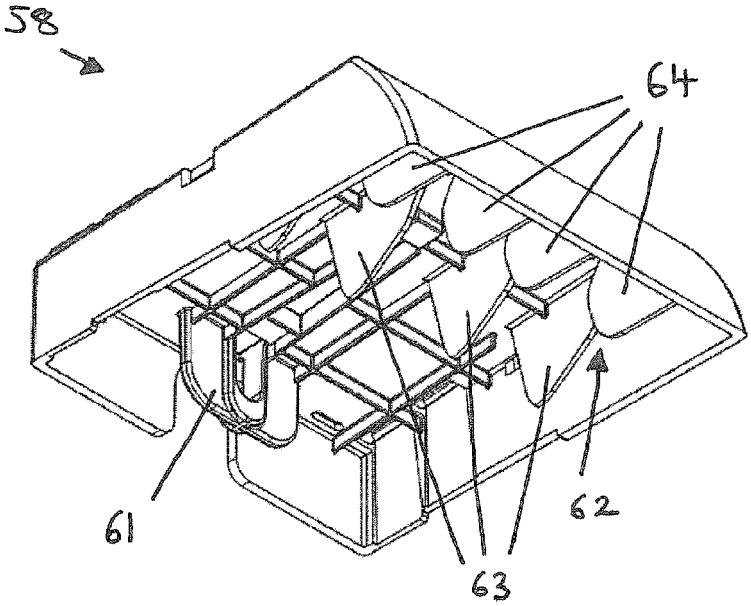
Figure 2H:
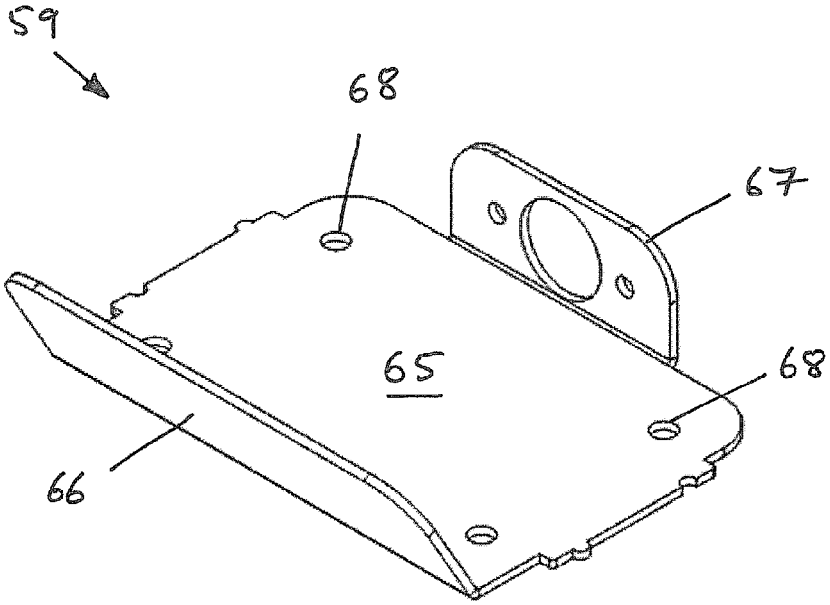
FIG. 2H shows a ticket dispenser base securing unit.

FIGS. 1A, 1B and 1C illustrate a ticket dispenser module 1 that is suitable for dispensing tickets from the end of a ribbon of tickets, for example for the display and dispensing of lottery tickets. The ticket dispenser 1 comprises a housing body 2, a housing door 3, a ticket control cam 4, a slideable security cover 5, a lock assembly 6 and a base assembly 7. The component parts of the ticket dispenser 1 are illustrated further in FIGS. 2A to 2H.

The housing body 2 comprises side faces 10 and 11, top face 12, bottom face 13, front end 14 and open end 15. The housing body 2 has interconnection elements comprising male slideable engagement elements 21, female slideable engagement elements 22, resiliently deflectable projections 23 and projection engagement holes 24 provided on the faces 10, 11, 12 and 13. The housing body 2 also has a hook 25 projecting from the bottom face 16 and an elongate, hook engagement slot 26 in the top face 12.

Adjacent the open end 15 and the bottom face 13, opposed sides 10 and 11 of the housing body 110, are provided with pivotal door engagement elements 27 (e.g. holes). A locking arm receiving slot 28 is provided in the top face 14 of the housing body 110 (i.e. the face remote from the pivotal door engagement elements 27).

The housing door 3 has pivotal body engagement elements 29 (e.g. shafts) configured to engage with the pivotal door engagement elements 27 of the housing body 2. The housing door 3 has a ledge 30 between two buttresses 31, which project from the external face 32 of the housing door. A pair of pivotal ticket dispensing cam engagement elements 33 (e.g. holes) are provided in the buttresses 31. An elongate ticket dispensing aperture 34 is provided adjacent the ledge 30, such that tickets may be dispensed out through the aperture and across the ledge. The ledge is provided with recesses 35 configured to receive resiliently deformable pads (e.g. foam) (not shown). A part-cylindrical security cover sliding surface 36 is provided between the end of the ledge 30 and the external face 32 of the door 3, with a pair of part-circular security cover guides 37. A pair of resiliently deformable ticket dispensing cam biasing elements 39 are provided. Upper and lower security cover apertures 40 and 41 are provided in the housing door 3, with a lock assembly receiving boss 42 provided between the upper security cover guide aperture 40 and the opening edge 42 (opposite the hinged edge 43) of the door.

The ticket control cam 4 has pivotal door engagement elements 44 configured to pivotally engage with the pivotal ticket dispensing cam engagement elements 33 of the housing door 3. The control cam 4 has security cover guides 45 to either side of a part-cylindrical, security cover sliding surface 46. Projecting cam stops 47 are configured to contact the cam biasing elements 39 of the door 3. One or more finger recesses (i.e. indentations) 48 facilitate depression of the cam 4 by a user, to increase the frictional engagement between the ribbon of tickets and the ledge 30 of the door 3, over which the ticket is being dispensed, in order to facilitate holding the ticket ribbon whilst a ticket is torn off. The recesses 48 are concavely shaped, and have a face that is generally parallel with the ledge, when in contact with the ledge (or a ticket jammed against the ledge). A ticket access cut-away 49 allows access to the end of a ticket beneath the cam 130.

The slideable security cover 5 has a part-cylindrical inner surface 50 with parallel sides 51 perpendicular to the axis of the cylindrical curvature. The inner surface 50 is configured to slideably engage with the part-cylindrical security cover sliding surface 36 of the housing door 3 and the part-cylindrical security cover sliding surface 46 of the ticket dispensing cam 4. The sides 51 are configured to engage with the security cover guides 37 and 45 of the housing door 3 and the ticket control cam 4. Accordingly, in use, the security cover 5 is slideable, about the axis of the cylindrical curvature of the inner surface 51, across the part-cylindrical security cover sliding surface 36 of the housing door 3 and the part-cylindrical security cover sliding surface 46 of the ticket dispensing cam 4. A stop 52 projects from the outer surface for engagement with the external face 32 of the door 3 to limit the sliding travel of the security cover 5. A handle 53 is provided to facilitate movement of the security cover 5 by a user. A locking arm receiving slot 54 is provided to receive an engagement arm of the lock assembly 6.

The lock assembly 6 comprises a central lock mechanism 55 with a key insertion slot 56, and a multi-way locking arm 57 having a first locking portion 57A and a second locking portion 57B. The multi-way locking arm 57 projects from the central axis of rotation of the lock mechanism 55. In a first direction the multi-way locking arm 57 has a radial extent R1, corresponding with the first locking portion 57A. In a second, opposite direction, and in a third direction perpendicular to the first and second directions, the locking arm 57 projects by a lesser radial extent R2 (i.e. R2<R1), corresponding with the second locking portion 57B. In a fourth direction opposed to the third, the multi-way locking arm 57 projects by a lesser radial extent, e.g. no radial projection beyond the lock mechanism 55. The illustrated central lock mechanism 55 is configured for operation with a toothed key. Alternatively, the central lock mechanism 55 may be configured for operation with a non-toothed key, such as a polygonal key (e.g. a square section key or an Allen® key). In a further alternative, in a case where a removable key is not required, then the lock assembly 6 may be provided with a handle for operation of the multi-way locking arm 57.

The base assembly 7 comprises a base unit 58 and a securing unit 59. A face 60 of the base unit 58 is provided with slideable engagement elements 22, projection engagement holes 24, and a hook engagement slot 26 for connection to the housing body 2. The opposite side of the base unit is provided with securing loop 61. A channel 62 is provided between a first set of fins 63 and a second set of fins 64. The securing unit 59 comprises a securing plate 65, a projecting plate 66 and a lock mounting plate 67. The securing plate 65 has securing holes 68 through which the securing unit may be screwed down to a retail counter. The projecting plate 66 extends from and is angled (i.e. non-parallel) with respect to the securing plate 65. The lock mounting plate 67 extends from the securing plate 65 is spaced from the projecting plate 66, and is configured to receive a lock (not shown in FIG. 2H).

Figure 3B:
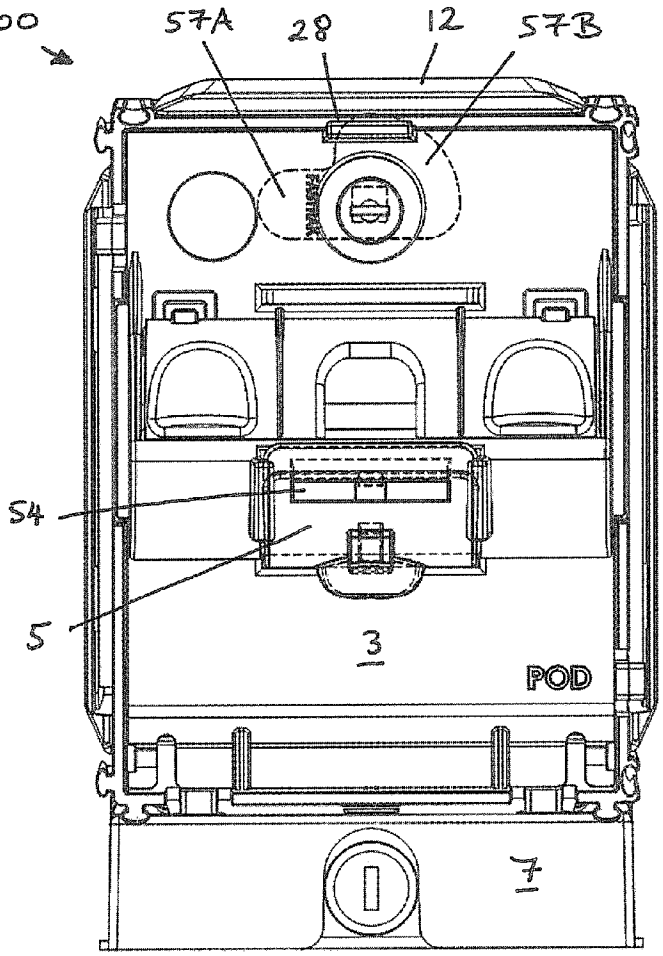
FIGS. 3A, 3B and 3C show a ticket dispenser with the lock assembly respectively in first, second and third modes of operation.
Figure 3A:
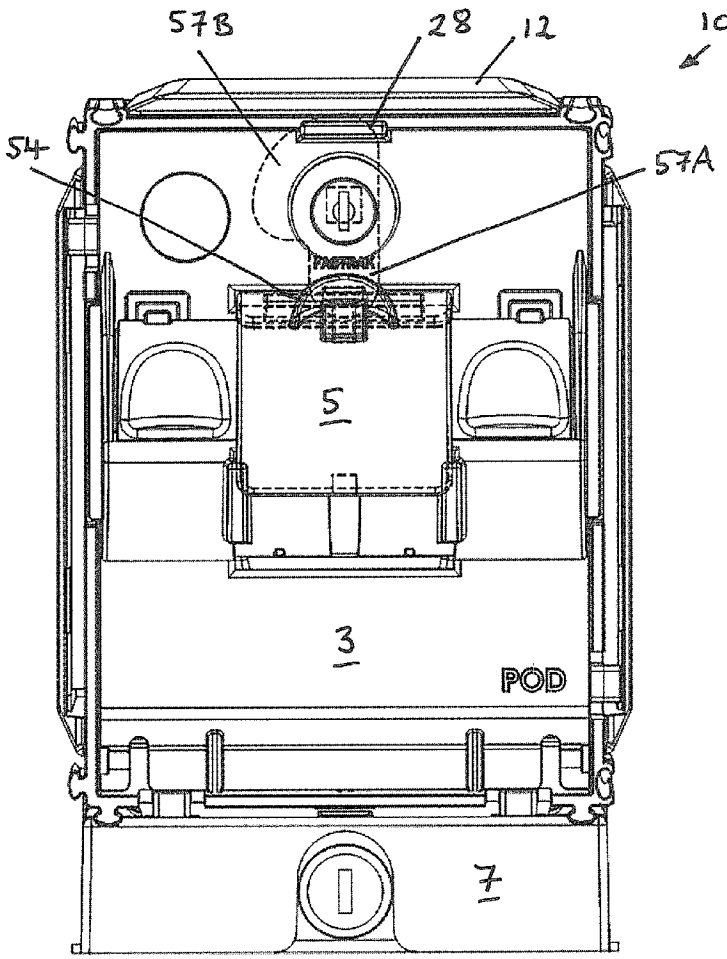
Figure 3C:
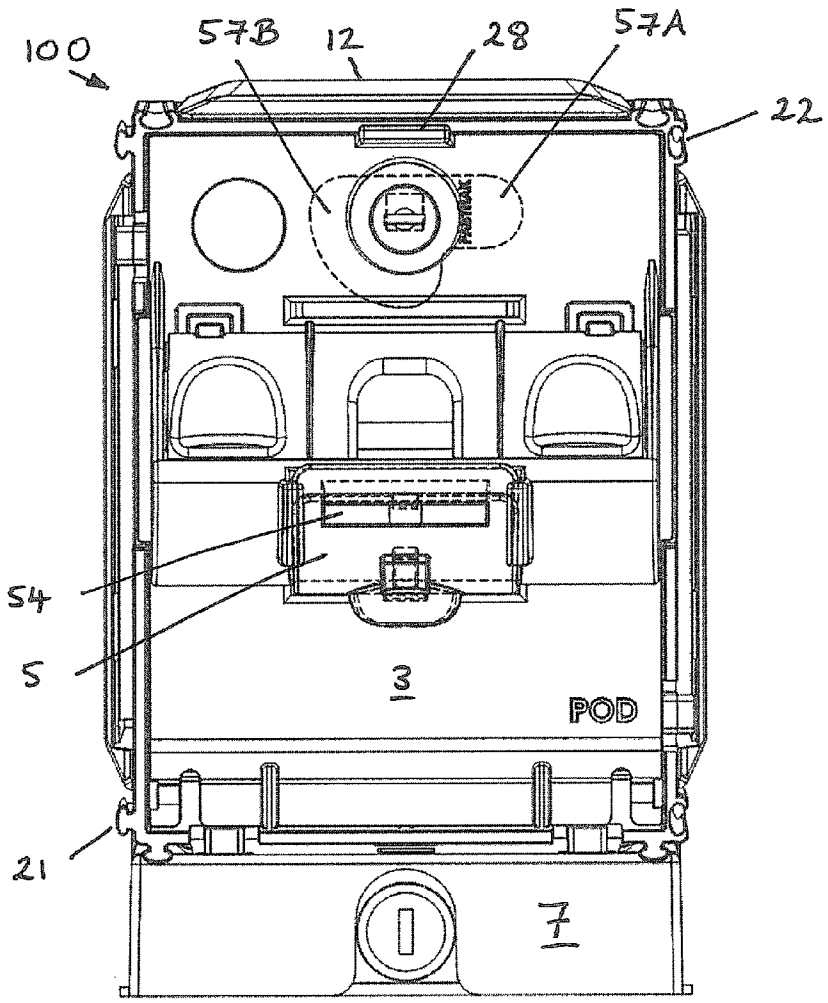

The multi-way locking arm 57 of lock assembly 6 is rotatable between three orientations, as illustrated in FIGS. 3A to 3C, in correspondence with FIGS. 1A to 10.

FIG. 3A (and FIG. 1A) illustrates a first orientation of the multi-way locking arm 57 in which the first locking portion 57A of the multi-way locking arm, which has the longest radial extent R1, engages with the locking arm receiving slot 54 of the slideable security cover 5, and the second locking portion 57B of the locking arm 57, which has a lesser radial extent R2, engages with the locking arm receiving slot 28 in the top face 12 of the housing body 2. Accordingly, in the first orientation of the locking arm 57, the security cover 5 and the housing door 3 are locked closed. When closed, the security cover 5 blocks the withdrawal of the ribbon of tickets through the elongate ticket dispensing aperture 34 (not shown in FIG. 3A) from within the housing body 2, and preferably clamps the ticket control cam 4 against the ledge 30.

FIG. 3B (and FIG. 1B) illustrates a second orientation of the multi-way locking arm 57, in which the second locking portion 57B of the multi-way locking arm 57, having the lesser radial extent R2, engages with the locking arm receiving slot 28 of the housing body 2, and the locking arm 57 does not engage with the security cover 5. Accordingly, in the second orientation of the locking arm 57, the housing door 3 is locked closed, and the security cover 5 is unlocked, and may be opened for the dispensing of tickets through the elongate ticket dispensing aperture 34.

FIG. 3C illustrates a third orientation of the multi-way locking arm 57, in which the multi-way locking arm 57 is orientated such that it does not engage with the locking arm receiving slot 28 of the housing body 2 or the locking arm receiving slot 54 of the security cover 5. Due to the relative separation of the axis of rotation of the multi-way locking arm 57 and the locking arm receiving slot 54 of the security cover 5, which is greater than the lesser radial extent R2 of the second locking portion 57B of the multi-way locking arm 57, the locking arm 57 does not engage with the locking arm receiving slot 54 of the security cover 5. Accordingly, in the third orientation of the locking arm 57 both the housing door 3 and the slideable security cover 5 are unlocked, and both the housing door 3 and the slideable security cover 5 may be opened, as per FIG. 1C.

By suitable operation of the lock assembly 6, the ticket dispenser module 1 may be reconfigured from a configuration in which both the housing door 3 and the security cover 5 are locked closed to another configuration in which the housing door remains locked but the security cover is unlocked, without the need to unlock the securing door. The lock assembly 6 may be configured such that it passes between the first and second orientations of the multi-way locking arm 57 without passing through the third orientation.

A master key may operate the lock assembly 6 to rotate the locking arm 57 between the three locking orientations illustrated in FIGS. 3A to 3C. Additionally, the lock assembly 6 may be operable by a servant key, which may only rotate the locking arm 57 between the first and second orientations, such that the servant key may only lock and unlock the security cover 5, and may not unlock the housing door 3.

Figure 4:
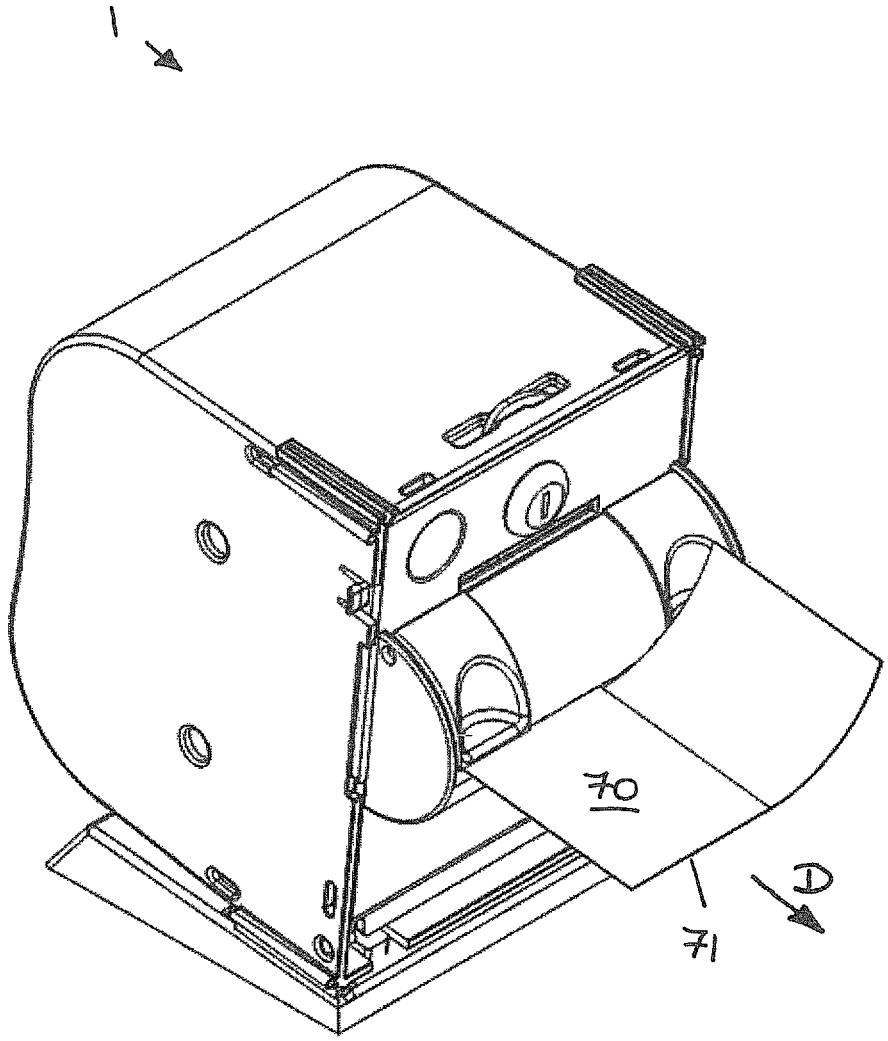
FIG. 4 shows a ticket dispenser with the housing door locked closed and the security cover unlocked and open, when a ticket is being dispensed.

FIG. 1C illustrates the ticket dispenser 1, when both the housing door 3 and the security cover 5 are unlocked, in correspondence with FIG. 3C, when the housing door 3 has been opened so that the housing body 2 may be loaded with a pleated ribbon of tickets 70. Once the ribbon of tickets 70 has been loaded into the housing body 2, the end 71 is fed out through the elongate dispensing aperture 34, between the ledge 30 and the ticket control cam 4, in a ticket dispensing direction. Then the housing door 3 is closed and re-locked with the security cover 5 remaining unlocked and slid open, as illustrated in FIG. 1B and FIG. 3B. The user may then withdraw the end 71 of the ribbon to tickets 70 from the ticket dispenser 1 in the ticket dispensing direction D, as illustrated in FIG. 4. Once the correct length of ticket ribbon 70 has been withdrawn, the user inserts fingers into the finger recesses 48 and depresses the ticket control cam 4, to jam the ribbon against the ledge 30 beneath the control cam, and then tears off the required length of tickets 70.

Even when the ticket control cam 4 is not pressed against the ledge 30 by the user, the cam is configured to apply a force onto the ribbon of tickets 70 between the cam and the ledge. Accordingly, once the ribbon of tickets 70 is released it is prevented from springing back (in the opposite direction to the ticket dispensing direction) into the interior of the housing body 2 and becoming inaccessible for dispensing further tickets. However, if an excess length of the ribbon of tickets 70 were withdrawn, the ticket control cam 4 could be lifted to permit the reinsertion of the excess.

The projecting cam stops 47 contact against the cam biasing elements 39 of the housing door 3, which bias the ticket control cam 4 towards the ledge 30. Additionally, or alternatively, the cam 4 may be biased towards the ledge 30 by a separate biasing element not shown). Further, the centre of mass of the ticket control cam 4 is further from the centre of the ticket dispenser 100 than the pivot axis 20 of the control cam, such that it in an upright position the control cam is drawn towards the ledge 30 under its own weight.

Figure 5A:
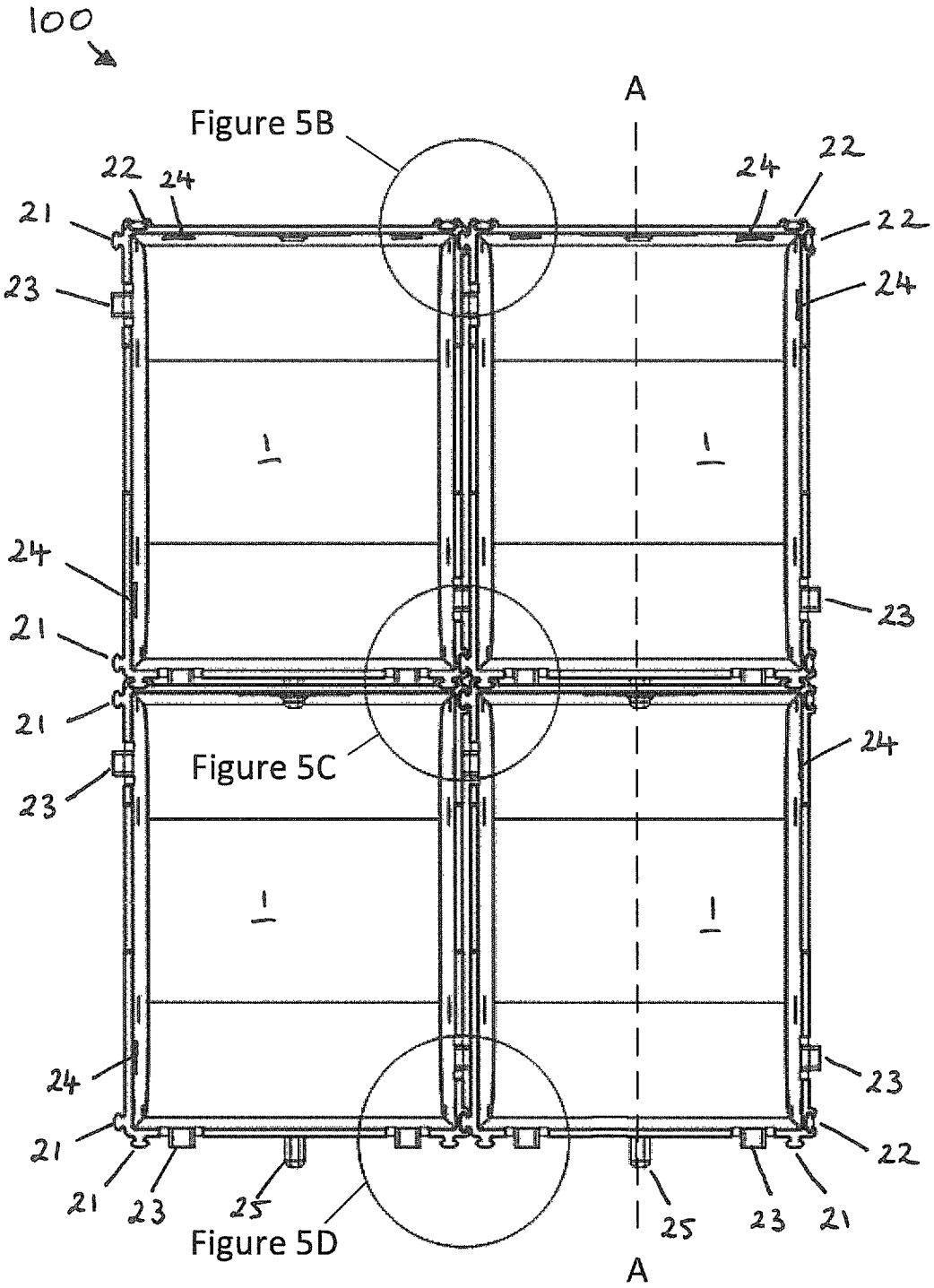
FIG. 5A shows four interconnected ticket dispenser modules.
Figure 5B:
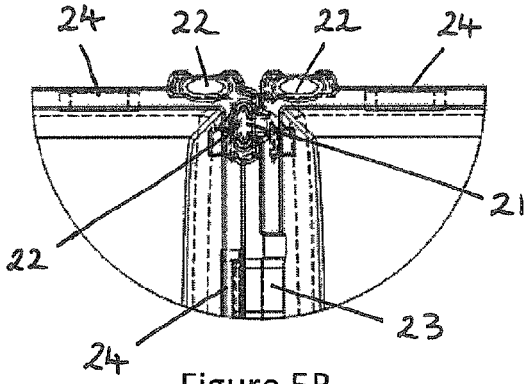
FIGS. 5B, 5C and 5D show enlarged views of parts of FIG. 5A.
Figure 5C:
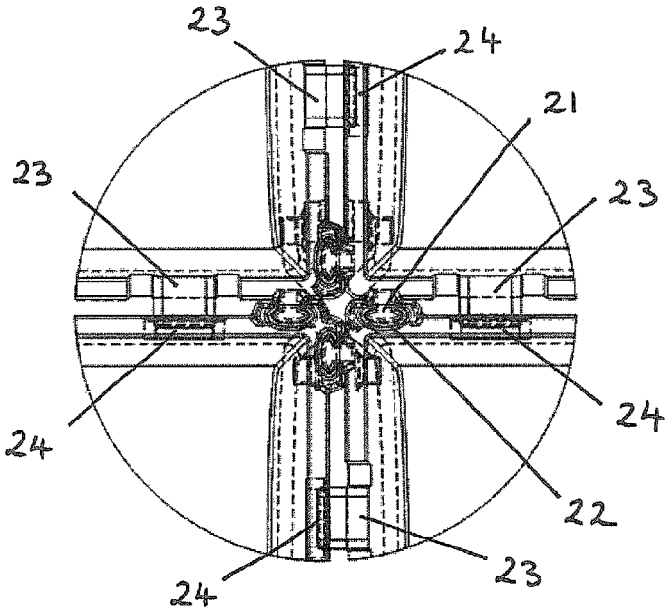
Figure 5D:
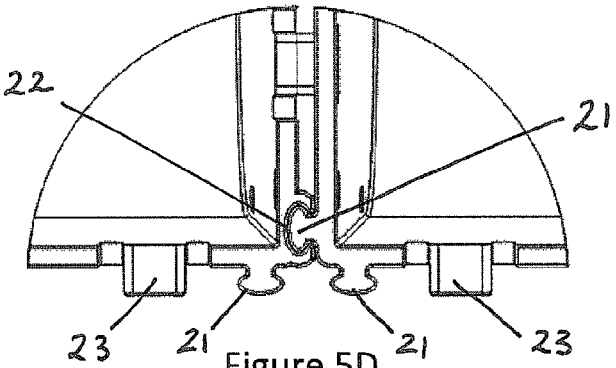

FIG. 5A illustrates a modular assembly 100 of four ticket dispenser modules 1 in a 2×2 arrayed arrangement. FIGS. 5B, 5C and 5D show enlarged views of parts of the assembly of FIG. 5A, and FIG. 5E shows a cross-sectional view along the plane indicated by the line A-A.

The opposite side faces 10 and 11 of the housing body have complementary arrangements of interconnection elements, 21, 22, 23 and 24 for side-by-side interconnection of ticket dispenser modules 1. Similarly, the opposite top face 12 and bottom face 13 have complementary arrangements of interconnection elements 21, 22, 23, 24, 25 and 26.

The male slideable engagement elements 21 are straight elongate ridges that are bulbous in cross-section (i.e. in cross-section, having a narrower neck joined to a wider portion, as per a T-shape) and tapered, narrowing along the length of the ridge, away from the open end 15 of the housing body 2 (e.g. having an elongate conical bulbous section). The female slideable engagement elements 22 are straight elongate grooves of a complementary shape to the male slideable engagement elements 21 (i.e. with narrower sides than their maximal width), and which are tapered along their length to narrow away from the open end 15 of the housing body 2

Figure 5E:
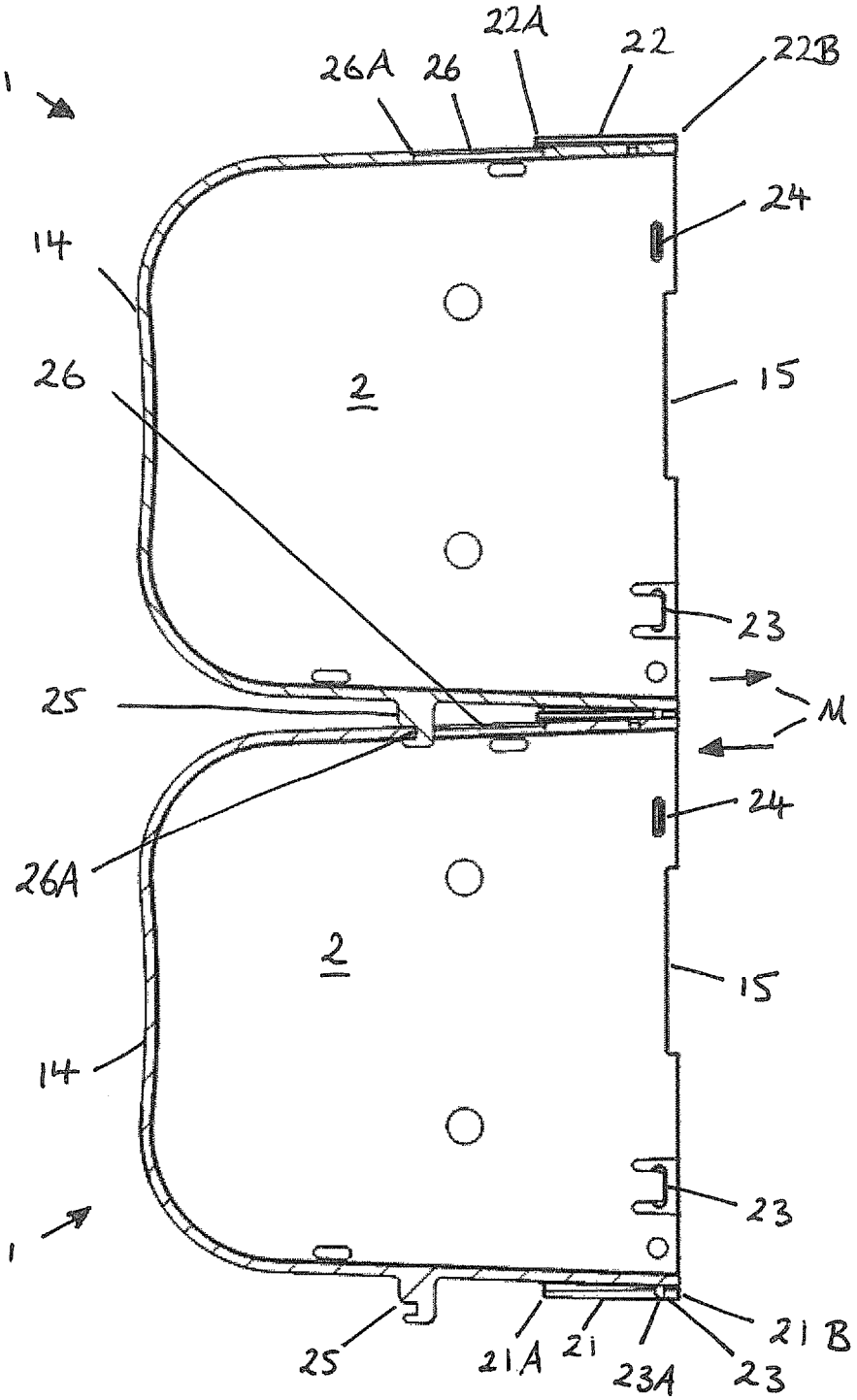
FIG. 5E shows a sectional view though a pair of interconnected ticket dispenser modules.

To connect together two modules, as illustrated in FIG. 5E, the upper and lower housing bodies 2 are brought together with a relative offset such that the narrower end 21A of the male slideable engagement element 21 can be inserted into the open wider end 22B of the female slideable engagement element 22, and the male element 21 is slid into engagement with the female element 22 by relative movement M of the housing bodies 2. Advantageously, the tapering of the male and female slideable engagement elements 21 and 22 enables a firmer connection to be established between the adjacent modules, than with mated non-tapered elements.

The complementary male and female slideable engagement elements 21 and 22 are configured to mate along less than half the length of each module (i.e. distance between front end 14 and open end 15), and preferably along less than one third of the length of each module. Preferably, the complementary male and female slideable engagement elements 21 and 22 mate along a length of less than 60 mm. Advantageously, such limitation of the length of the elements 21 and 22, facilitates convenient inter-connection of modules, and increases manufacturing tolerances, compared with longer elements. Further advantageously, such restriction of the lengths enables the tapered engagement elements 21 and 22 to be manufactured by an injection moulding process, by enabling the male element to remain wide enough at the narrow end to retain sufficient strength for typical retail use, without the wide end becoming so thick that it is at risk of deformation during post-manufacture cooling of the injection moulding material. The taper also facilitates withdrawal of the elements from the injection mould. The taper between the opposite sides of the male slideable engagement element 21 may be between 2° and 10° (e.g. the element may have a taper of between 1° and 5° on each side). The illustrated male slideable engagement element 21 is 40 mm long and tapers in width between 6 mm and 4 mm, having a taper between the sides of approximately 3°.

When the upper and lower housing bodies 2 of FIG. 5E are brought together, offset, the hook 25 that projects from the bottom face 13 extends through the hook engagement slot 26 (which is also tapered, narrowing away from the open end 15) in the top face 12. Following the relative movement M of the housing bodies 2, the hook 25 mates with the narrow end 26A of the hook engagement slot 26 to provide a third point of support between the upper and lower housing bodies 2.

The three points of support between adjacent interconnected modules (e.g. the two pairs of male and female slideable engagement elements 21 and 22 and the hook 25 and hook engagement slot 26) are spaced apart and not co-linear, in order to provide stability against relative angular movement of interconnected adjacent modules. The male and female slideable engagement elements 21 and 22 are spaced apart, close to the side-corners of the modules, to provide lateral stability against relative angular movement of the connected adjacent modules. The male and female slideable engagement elements 21 and 22 are adjacent an end (e.g. the open end 15, as illustrated) of the housing body 2, and the third point of support is spaced apart from them, towards the front end 14, to provide stability against relative angular movement of the connected adjacent modules in a perpendicular direction.

Although in the illustrated modular assembly 100, the third point of support comprises an arrangement of a hook 25 and a hook engagement slot 26. However, it will be appreciated that alternatively the third point of support may be provided by a further male and female slideable engagement element 21 and 22.

During the relative movement of the housing bodies 2, when the male and female slideable engagement elements 21 and 22 are brought into engagement, the resiliently deformable projection 23 that projects from the bottom face 13 of the upper housing body 2 slides along the top face 12 of the lower housing body 2 from the open end 15 to become engaged with the projection engagement holes 24. To facilitate the projections 23 in being resiliently deformed, in order to slide along the top face 12, the projections are provided with a bevelled face 23A facing away from the open end 15. Engagement of the projections 23 with the holes 24 acts as a latch to retain the relative positions of the upper and lower housing bodies 2 to prevent further relative movement, for example in the opposite direction to the relative movement M used in interconnection of the housing bodies 2, thereby preventing disengagement of the male and female slideable engagement elements 21 and 22.

The complementary arrangements of interconnection elements 21, 22, 23 and 24 on the side faces 10 and 11 enable corresponding, latched, side-by-side assembly of the housing bodies 2. Again, the interconnection elements 21, 22, 23 and 24 on the side faces 10 and 11 are spaced apart to provide stability, and on the illustrated housing bodies 2 are provided at the top and bottom corners, adjacent the top face 12 and bottom face 13. Advantageously, the provision of interconnection elements on both the top and bottom faces 12 and 13, and the side faces 10 and 11, enables the modules 1 to be assembled into a 2-dimensional array (i.e. both vertically and laterally interconnected modules), and even for the modules to be assembled into shapes such as a bridge.

Although not illustrated, a third point of support may additionally be provided between the adjacent side faces 10 and 11 of the housing bodies 2, which is spaced apart from the first and second points of support, and not co-linear with them. Again, the third point of support may be an arrangement of a hook 25 and a hook engagement slot 26, or a further male and female slideable engagement element arrangement. However, in the case that the lower modules in an arrangement are firmly secured (e.g. to a retail counter), then a third point of contact may not be required in side-by-side interconnection.

Figure 5F:
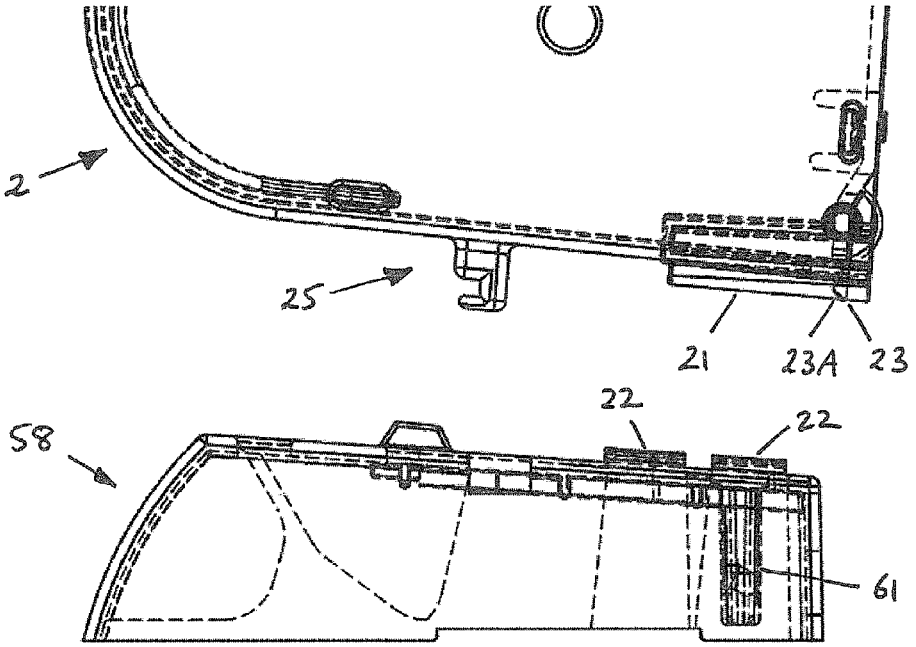
FIGS. 5F, 5G and 5H show the interconnection between a ticket dispenser module, a base unit and a securing unit.
Figure 5H:
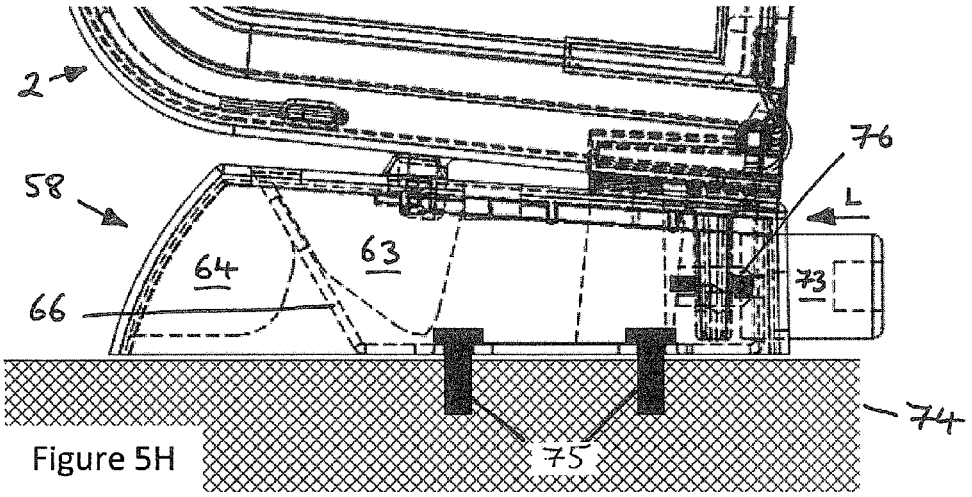

Similarly, the face 60 of the base unit 58 is provided with interconnection elements 22, 24 and 26 to enable interconnection with the complementary interconnection elements 21, 23 and 25 on the bottom face 13 of the housing bodies 2, as shown in FIG. 5F.

To disengage the housing bodies 2, when the resiliently deformable projections 23 are engaged within the projection engagement holes 24, the resiliently deformable projections 23 may be disengaged by pushing outwards from within the interior of the housing body 2 having the holes 24. Security is enhanced by disengagement only being possible when the interior of the corresponding housing body 2 is accessible, by the door 3 being unlocked and open. Further, the door 3 of the upper housing body 2 is configured to prevent the disengagement of the projections 23 from the lower face 13 from the holes 24 in the upper face 12 of the lower housing body 2 when the door 3 of the upper housing body 2 is also open.

The securing unit 59 is provided with a lock mechanism 73 on the lock mounting plate 67, and is screwed onto a surface 74 (e.g. a retail counter) by screws 75.

Figure 5G:
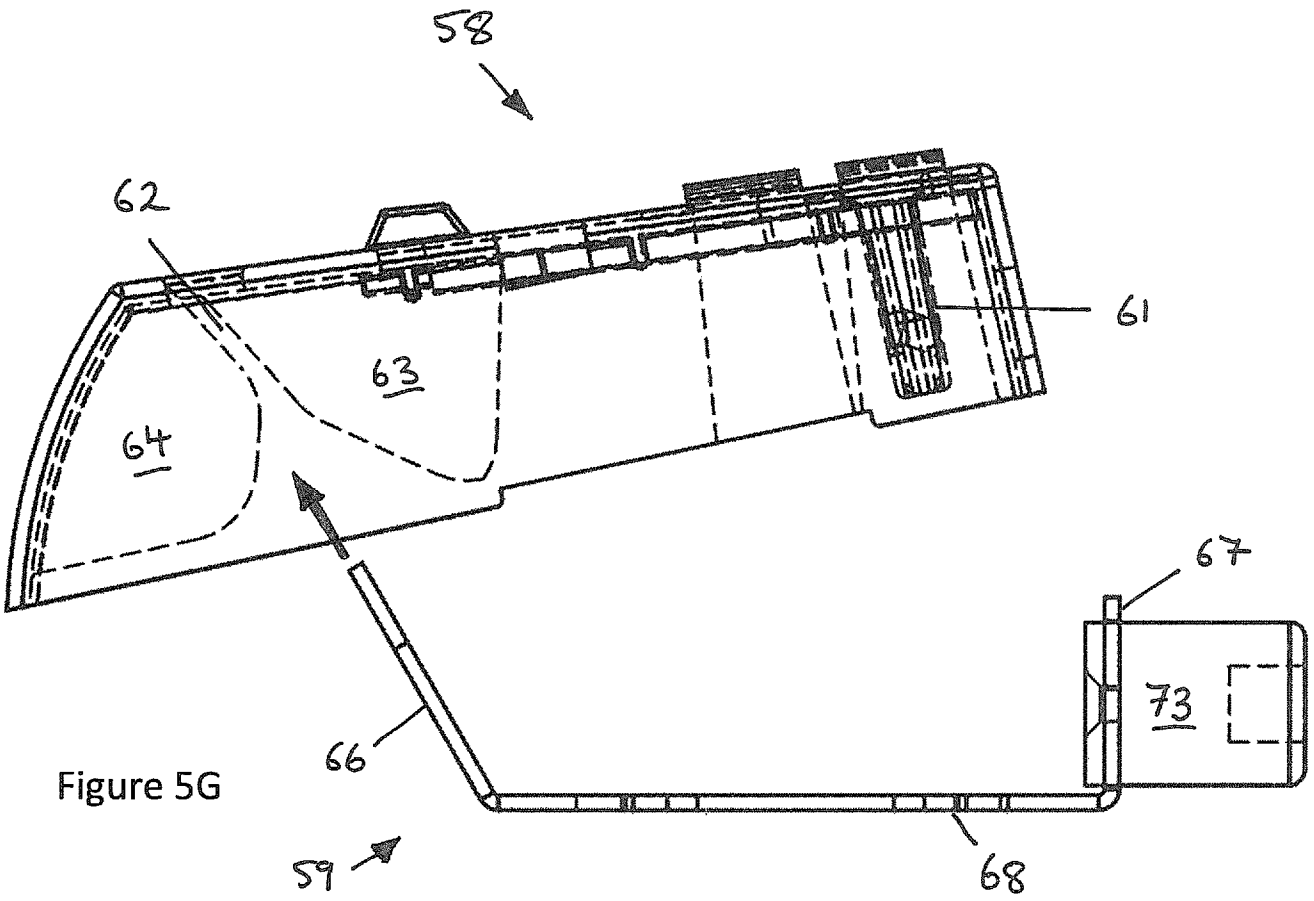

To secure the base unit 58 (e.g. when already interconnected with a housing body 2) onto the securing unit 59, the base unit is lowered onto the projecting plate (projecting element) 66 such that it is received into the channel 62 between the fins 63 and 64, as indicated in FIG. 5G.

The base unit 58 is then further lowered, such that the lock mounting plate 67 is received within the base unit 58. The lock 73 is then operated such that a locking rod 76 is extended through the securing loop 61. When the securing loop 61 and the lock mounting plate 67 are interlocked, the base unit 58 cannot be raised such that the projecting plate 66 is withdrawn from the channel 62, due to the angle at which the projecting plate extends from the surface 74, which is non-perpendicular, and which corresponds with the angle of the channel 62. Accordingly, the base unit 58 is held in place on the securing unit 59 by its mechanical engagement with the pivot plate 66 and the lock mechanism 73.

The figures provided herein are schematic and not to scale.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

A base assembly for the ticket dispensing module will now be described with reference to the following clauses:

1. A base assembly for a ticket dispensing module comprising a securing unit for securing to a securing surface and a base unit configured to lockably connect a ticket dispensing module to the securing unit, wherein the securing unit has a projecting section and a first lock section that are spaced apart, the projecting section is configured to project from a securing surface to which the securing unit may be secured, the base unit has a channel for receiving the projecting section of the securing unit, and the base unit has a second lock section configured to engage with the first lock section of the securing unit, and a lock is operable to interlock the first lock section and the second lock sections, and the projecting section and the channel are configured to prevent separation of the projecting section and the channel when the first and second lock sections are interlocked.

2. A base assembly according to clause 1, wherein the projecting section is a projecting plate section.

3. A base assembly according to clause 2, wherein the channel is defined between a first and a second plurality of fins that are configured to be transverse to the projecting plate section when the projecting plate section is received within the channel.

4. A base assembly according to clause 2 or 3, wherein the projecting section is a projecting plate section configured to extend non-perpendicularly from a securing surface to which the securing unit may be secured.

5. A base assembly according to any one of clause 1, 2, 3 or 4, wherein the first lock section comprises a lock engagement hole, the lock is connected to the second lock section and the lock is operable to extend a locking rod through the lock engagement hole.

The invention claimed is:

1. A ticket dispenser comprising a housing body, a lockable housing door configured to close an opening in the housing body, a ticket dispensing aperture, a lockable security cover configured to prevent the removal of tickets through the dispensing aperture, and a lock assembly having a multi-way locking arm, wherein the locking arm is configured to lock the housing door and security cover when the locking arm is in a first orientation, in which the locking arm engages with the security cover, wherein the locking arm is configured to lock the housing door and not to lock the security cover when the locking arm is in a second orientation, and wherein the locking arm is configured not to lock the housing door or the security cover when the locking arm is in a third orientation.

2. A ticket dispenser according to claim 1, wherein the lock assembly comprises:

a rotatable central lock mechanism having an axis of rotation; and the multi-way locking arm, the locking arm extending transversely to the axis of rotation and having a first locking portion with a radial extent of R1, a second locking portion having a radial extent of R2, wherein R2 is less than R1, and a further portion having a radial extent of less than R2.

3. A ticket dispenser according to claim 1, wherein the lock assembly is configured such that a master key may change the lock assembly between the first, second and third orientations, but a servant key may only change the lock assembly between the first and second orientations.

4. A ticket dispenser according to claim 1, wherein the security cover is a slideable security cover configured to slide between an open position in which a ribbon of tickets may be withdrawn through the ticket dispensing aperture from within the ticket dispenser, and a closed position in which the security cover prevents withdrawal of tickets through the ticket dispensing aperture from within the ticket dispenser.

5. A ticket dispenser according to claim 1, wherein the security cover is a slideable security cover having a part-cylindrical inner surface configured to slideably engage with a part-cylindrical security cover sliding surface of the housing door.

6. A ticket dispenser according to claim 1, wherein the lock assembly is mounted on the housing door, wherein the locking arm is configured to engage with the housing body and security cover to lock the housing door and security cover when the locking arm is in the first orientation, wherein the locking arm is configured to engage with the housing body to lock the housing door and not to lock the security cover when the locking arm is in the second orientation, and wherein the locking arm is configured not to engage with the housing body or security cover and not to lock the housing door or the security cover when the locking arm is in the third orientation.

7. A ticket dispenser comprising a housing body, a lockable housing door configured to close an opening in the housing body, a ticket dispensing aperture in a wall of the housing body, a lockable security cover configured to prevent the removal of tickets through the dispensing aperture, a lock assembly having a multi-way locking arm, wherein the locking arm lock assembly is configured to lock the housing door and security cover when the locking arm is in a first orientation, in which the locking arm engages with the security cover, wherein the locking arm lock assembly is configured to lock the housing door and not to lock the security cover when the locking arm is in a second orientation, and wherein the locking arm lock assembly is configured not to lock the housing door or the security cover when the locking arm is in a third orientation, and a ledge projecting from the wall that is external to the housing body and adjacent to the dispensing aperture, and a pivotable ticket control cam, wherein the housing body is configured for the dispensing of tickets out through the dispensing aperture between the control cam and the ledge, the control cam is configured to urge tickets against the ledge to hinder the return of tickets into the ticket dispenser, and the pivotable ticket control cam comprises an indentation configured to receive a user's digit for manually jamming the control cam against the ledge.

8. A ticket dispenser according to claim 7, wherein the housing body is configured for tickets to be dispensed in a dispensing direction and the centre of mass of the pivotable ticket control cam is further from the centre of the ticket dispenser than a pivot axis of the control cam, in the dispensing direction.

9. A ticket dispenser according to claim 7, wherein the pivotable ticket control cam is biased towards the ledge.

10. A ticket dispenser according to claim 7, wherein the pivotable ticket control cam has a recess to facilitate a user's access to a ticket located between the control cam and the ledge.

11. A ticket dispensing module comprising:

a housing body, a lockable housing door configured to close an opening in the housing body, a ticket dispensing aperture, a lockable security cover configured to prevent the removal of tickets through the dispensing aperture, and a lock assembly having a multi-way locking arm, wherein the locking arm lock assembly is configured to lock the housing door and security cover when the locking arm is in a first orientation, in which the locking arm engages with the security cover, wherein the locking arm lock assembly is configured to lock the housing door and not to lock the security cover when the locking arm is in a second orientation, wherein the locking arm lock assembly is configured not to lock the housing door or the security cover when the locking arm is in a third orientation, wherein the housing body comprises opposed first and second faces provided with first and second complementary slideable engagement elements and latching elements, the first slideable engagement element of a first housing body being engageable with the second slideable engagement element of a corresponding, second housing body, by relative displacement of the housing bodies, wherein the first and second slideable engagement elements of the housing bodies are configured to prevent separation of the housing bodies transverse to the direction of relative displacement when they are engaged, and wherein the latching elements are configured to become engaged when the first and second slideable engagement elements have been engaged with one another by relative displacement of the housing bodies, and the latching elements are configured to prevent further relative displacement of the housing bodies when the latching elements are engaged.

12. A module according to claim 11, wherein the housing body has opposed third and fourth faces each connecting between the first and second faces, and wherein the third and fourth faces are provided with complementary slideable engagement elements and latching elements.

13. A module according to claim 11, having a base provided with a slideable engagement element and a latching element complementary to a face of the housing body.

14. A module according to claim 11, wherein the first slideable engagement elements are elongate and bulbous in cross-section, and the second slideable engagement elements are complementarily shaped grooves configured to mate with first slideable engagement elements of corresponding housing bodies.

15. A module according to claim 14, wherein at least one of the slideable engagement elements is tapered along the direction of elongation.

16. A module according to claim 14, wherein the first and second slideable engagement elements are each configured to mate along less than half the length of the housing body, when mated with a corresponding engagement element.

17. A module according to claim 14, wherein each of the opposed first and second faces are provided with at least two slideable engagement elements that are spaced apart.

18. A module according to claim 11, wherein one of the opposed first and second faces is provided with a hook and the other of the opposed first and second faces is provided with a complementary hook engagement hole.

19. A module according to claim 11, wherein the latching elements comprise a resiliently deflectable projection and a projection engagement hole.

20. A module according to claim 19, wherein the module comprises a door and the door inhibits deflection of the projection when the door is in the closed position.

* * * * *